US007314272B2

(12) United States Patent
Kojima et al.

(10) Patent No.: US 7,314,272 B2
(45) Date of Patent: Jan. 1, 2008

(54) INK CARTRIDGE HAVING ONE CHAMBER SURROUNDING ANOTHER CHAMBER

(75) Inventors: Yoshinori Kojima, Kawasaki (JP); Hajime Yamamoto, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 325 days.

(21) Appl. No.: 11/146,593

(22) Filed: Jun. 7, 2005

(65) Prior Publication Data

US 2005/0275697 A1 Dec. 15, 2005

(30) Foreign Application Priority Data

Jun. 14, 2004 (JP) ..... 2004-175546

(51) Int. Cl.
*B41J 2/175* (2006.01)

(52) U.S. Cl. ..... 347/86; 347/85

(58) Field of Classification Search ..... 347/85, 347/86, 87

See application file for complete search history.

(56) References Cited

U.S. PATENT DOCUMENTS

| | | | | |
|---|---|---|---|---|
| 5,430,471 | A * | 7/1995 | Nakajima et al. | 347/87 |
| 5,489,932 | A * | 2/1996 | Ceschin et al. | 347/87 |
| 5,877,794 | A * | 3/1999 | Takagi | 347/87 |
| 5,971,530 | A * | 10/1999 | Hashimoto | 347/86 |
| 6,137,512 | A | 10/2000 | Higuma | |
| 6,231,172 | B1 * | 5/2001 | Koitabashi et al. | 347/86 |
| 6,450,630 | B2 * | 9/2002 | Kanaya et al. | 347/86 |
| 2002/0167570 | A1 * | 11/2002 | Udagawa et al. | 347/85 |
| 2003/0020792 | A1 * | 1/2003 | Udagawa et al. | 347/86 |
| 2003/0142178 | A1 * | 7/2003 | McKinnell et al. | 347/86 |
| 2004/0223038 | A1 * | 11/2004 | Aponte et al. | 347/86 |
| 2005/0248636 | A1 * | 11/2005 | Lui | 347/86 |

FOREIGN PATENT DOCUMENTS

| | | | |
|---|---|---|---|
| CN | 1403290 | A | 3/2003 |
| JP | 6-328710 | A | 11/1994 |
| JP | 8-20115 | A | 1/1996 |
| JP | 2000-301740 | A | 10/2000 |

* cited by examiner

*Primary Examiner*—Hai Pham
*Assistant Examiner*—Carlos A. Martinez, Jr.
(74) *Attorney, Agent, or Firm*—Canon U.S.A. Inc I.P.D.V.

(57) ABSTRACT

An ink cartridge in which a space inside the ink cartridge is divided by a cylindrical bulkhead into two parts, a negative pressure generator chamber located inside the bulkhead and a liquid chamber located outside the bulkhead. The negative pressure generator chamber communicates with the atmosphere via an air intake port, communicates with an ink supply port, and contains a negative pressure generator. The liquid chamber contains liquid ink directly. The negative pressure generator chamber and the liquid chamber communicate with each other only via a communicating portion provided in the bulkhead. The entire peripheral surface of the lower portion of the negative pressure generator is in contact with the ink in the liquid chamber through the communicating portion continuously provided in the bulkhead.

14 Claims, 12 Drawing Sheets

INK CARTRIDGE HAVING ONE CHAMBER SURROUNDING ANOTHER CHAMBER

BACKGROUND OF THE INVENTION

1. Field of the Invention

The present invention relates to an ink cartridge that is a container for holding liquid to be supplied to an ink-jet recording head.

2. Description of the Related Art

An ink cartridge is a liquid container used for an ink-jet recording apparatus. In order to provide a good ink supply to a recording head that discharges ink, the ink cartridge is provided with a structure for controlling the power to hold ink in the cartridge. This power makes the pressure in an ink-discharging portion of the recording head lower than atmospheric pressure, and therefore is called "negative pressure." A member generating this power is called a negative pressure generator.

Japanese Patent Laid-Open No. 06-328710 (corresponding to U.S. Pat. No. 6,231,172) proposes an ink cartridge including a liquid chamber that uses a negative pressure generator to absorb ink, increases ink capacity per unit volume of the ink cartridge, and is capable of stable ink supply.

FIG. 12A is a schematic sectional view showing an ink cartridge having such a structure. The interior of the ink cartridge 10 is divided into two spaces by a partition wall (bulkhead) 38 having a communicating hole (communicating portion) 40.

One space is a liquid chamber 36 that is hermetically sealed except for the communicating hole 40 and holds ink 25 directly. The other space is a negative pressure generator chamber 34 containing a negative pressure generator 32.

The negative pressure generator chamber 34 is provided with an air intake 12 through which air is introduced into the ink cartridge 10 with ink consumption, and an ink outlet 14 through which ink is supplied to a recording head (not shown).

In FIGS. 12A to 12C, the shaded area shows the ink held in the negative pressure generator 32.

As shown in FIGS. 12A to 12C, a groove 50 for facilitating air introduction into the liquid chamber 36 is provided in the vicinity of the communicating hole 40 between the negative pressure generator chamber 34 and the liquid chamber 36.

Ribs 42 are provided in the vicinity of the air intake 12 to form a space (a buffer chamber) 44 not containing the negative pressure generator 32.

In FIGS. 12A to 12C, the dashed line 61 at the top of the shaded area represents a gas-liquid interface. As ink is supplied to the recording head and consequently the ink in the negative pressure generator 32 is consumed, the gas-liquid interface lowers.

As ink is consumed, air is introduced from the air intake 12 into the negative pressure generator chamber 34. The air enters the liquid chamber 36 through the communicating hole 40 of the partition wall 38.

As air is introduced, the ink in the liquid chamber 36 enters the negative pressure generator chamber 34 through the communicating hole 40 of the partition wall 38, and the negative pressure generator 32 is filled with ink. This movement of air and ink is called "gas-liquid exchange." As ink is consumed by the recording head for recording, the same amount of ink as consumed moves from the liquid chamber 36 to the negative pressure generator chamber 34 by gas-liquid exchange to fill the negative pressure generator 32.

By such gas-liquid exchange, the negative pressure generator 32 holds a constant amount of ink (maintains the level of the interface 61), and keeps the negative pressure in the recording head substantially constant. Therefore, ink supply to the recording head is stabilized.

Such an ink cartridge is productized by CANON KABUSHIKI KAISHA, and continues to be used.

Japanese Patent Laid-Open No. 08-020115 (corresponding to U.S. Pat. No. 6,137,512) proposes an ink cartridge using thermoplastic olefin resin fiber as a negative pressure generator.

This ink cartridge has excellent stability of ink storage. In addition, since the case and the negative pressure generator are formed of the same material, this ink cartridge has excellent recycling efficiency.

Recent ink-jet recording apparatuses have highly improved recording speeds and consume a large amount of ink for recording.

That is to say, the amount of ink to be supplied from the ink cartridge to the recording head per unit time is large.

In the above-described conventional ink cartridge, when a recording operation requiring a large amount of ink supply to the recording head is performed continuously, air supply from the negative pressure generator chamber 34 to the liquid chamber 36 becomes insufficient.

As a result, ink supply from the liquid chamber 36 to the negative pressure generator chamber 34 is interrupted, gas-liquid exchange becomes insufficient, and the liquid level (interface) in the negative pressure generator (liquid absorber) 32 lowers.

As a result, ink supply to the recording head becomes insufficient. Although some ink is left in the liquid chamber 36, the amount of ink in the negative pressure generator 32 decreases. Ink supply to the recording head can be interrupted. In such a case, recording cannot be continued.

How ink supply is interrupted in the conventional ink cartridge will be described with reference to FIGS. 12A to 12C. FIG. 12A shows gas-liquid exchange when a relatively small amount of ink is supplied from the conventional ink cartridge 10 to the ink-jet recording head (not shown).

In this state, the amount of ink supplied to the ink-jet recording head is relatively small. Therefore, the amount of ink going out of the liquid chamber 36 is the same as the amount of air introduced into the liquid chamber 36, in other words, the amounts balance out.

That is to say, the level of the gas-liquid interface 61 in the negative pressure generator 32 is kept substantially constant, in the vicinity of the point 51 where the upper end of the groove 50 comes into contact with the negative pressure generator 32.

In this state, the air passage when gas-liquid exchange is performed is the area around the point 51 in FIG. 12A. Three-dimensionally, the air passage is only part or all of the area around the line segment passing through the point 51 and extending perpendicular to the drawing, across the width of the groove 50. Therefore, if the amount of ink to be supplied to the ink-jet recording head significantly increases, it is impossible to introduce the same amount of air from the outside of the ink cartridge 10 via the negative pressure generator chamber 34 into the liquid chamber 36.

The same amount of ink as the amount of air that can be introduced from the negative pressure generator chamber 34 into the liquid chamber 36 through the above-described air passage moves from the liquid chamber 36 into the negative pressure generator chamber 34. In order to satisfy demand, a larger amount of ink than the amount of incoming ink goes out of the negative pressure generator 32 (operation A).

Therefore, as shown in FIG. 12B, the level of the gas-liquid interface 61 in the negative pressure generator 32 lowers.

Air goes out towards the liquid chamber 36 through the surface of the negative pressure generator 32 that faces the groove 50. Hereinafter, this surface 33 is referred to as the air outlet. With the lowering of the level of the gas-liquid interface 61, the area of the air outlet 33 increases and more air is introduced into the liquid chamber 36 (operation B).

By the combination of operations A and B, the level of the gas-liquid interface 61 lowers and the area of the air outlet 33 increases until the same amount of air as the amount of ink supplied to the head is introduced from the negative pressure generator chamber 34 into the liquid chamber 36.

Finally, when the amount of ink moving from the liquid chamber 36 into the negative pressure generator chamber 34 becomes the same as the amount of ink supplied to the head, the level of the gas-liquid interface 61 stops lowering, and it becomes possible to supply ink to the head without lowering the level of the gas-liquid interface 61.

However, at this time, lowering of the level of the gas-liquid interface 61 increases the negative pressure in the ink cartridge. This makes the ink supply to the recording head unstable, and affects the recording (printing) of the ink-jet recording apparatus.

In the case where the ink supply increases unexpectedly, for example, threefold or fivefold, the amount of ink moving from the liquid chamber 36 into the negative pressure generator chamber 34 cannot be the same as the amount of ink supplied to the head. The level of the gas-liquid interface 61 continues to lower at a faster rate than the increase in the area of the air outlet 33. Finally, as shown in FIG. 12C, the gas-liquid interface 61 reaches the ink supply port 14. This causes disruption of the ink supply to the head, and makes recording not possible.

SUMMARY OF THE INVENTION

The present invention is directed to a reliable ink cartridge. When the ink cartridge is used in an ink-jet recording apparatus having a highly improved recording speed and large amount of ink is supplied to the recording head, stable and uninterrupted ink supply is performed and stable recording is performed.

In an aspect of the present invention, an ink cartridge includes a negative pressure generator configured to absorb and hold liquid, a negative pressure generator chamber, a liquid chamber, and a partition wall. The negative pressure generator chamber contains the negative pressure generator. The negative pressure generator chamber includes a liquid supply port for supplying liquid to a recording head, and an air intake communicating with the atmosphere. The liquid chamber contains liquid. The partition wall has a communicating portion connecting the negative pressure generator chamber and the liquid chamber. The partition wall separates the negative pressure generator chamber and the liquid chamber except at the communicating portion. The liquid chamber is substantially hermetically-sealed except at the communicating portion. The negative pressure generator chamber is surrounded by the liquid chamber. The communicating portion is provided in the partition wall continuously or in a plurality of places in the partition wall.

In another aspect, the negative pressure generator chamber is surrounded by the liquid chamber except at a part of the circumference of the negative pressure generator chamber.

Since the air outlet is provided widely around the negative pressure generator, gas-liquid exchange can be performed widely around the negative pressure generator. Therefore, stable and uninterrupted liquid supply to the recording head is possible.

In another aspect of the present invention, an ink cartridge includes a negative pressure generator configured to absorb and hold liquid, a negative pressure generator chamber, a liquid chamber, and a partition wall. The negative pressure generator chamber contains the negative pressure generator. The negative pressure generator chamber includes a liquid supply port for supplying liquid to a recording head, and an air intake communicating with the atmosphere. The liquid chamber contains liquid. The partition wall has a communicating portion connecting the negative pressure generator chamber and the liquid chamber. The partition wall separates the negative pressure generator chamber and the liquid chamber except at the communicating portion. The liquid chamber is substantially hermetically-sealed except at the communicating portion. The liquid chamber is surrounded by the negative pressure generator chamber. The communicating portion is provided in the partition wall continuously or in a plurality of places in the partition wall.

In another aspect, the liquid chamber is surrounded by the negative pressure generator chamber except at a part of the circumference of the negative pressure generator chamber.

In one embodiment, the negative pressure generator may have a cylindrical or square pillared shape.

In the case where the negative pressure generator chamber has a square pillared shape, when the negative pressure generator is inserted into the negative pressure generator chamber, the negative pressure generator can be inserted along the corner of the partition wall. Therefore, an ink cartridge having high productivity and capable of stable ink supply can be provided.

In both of the above aspects, the liquid chamber, the communicating portion, and the negative pressure generator chamber contain liquid; air is introduced into the negative pressure generator chamber from the air intake with consumption of liquid in the negative pressure generator; the air then comes into the liquid chamber through the communicating portion; and when liquid in the liquid chamber is introduced into the negative pressure generator chamber through the communicating portion to fill the negative pressure generator, the substantially entire peripheral surface or part of the peripheral surface of the negative pressure generator communicating with the liquid chamber is capable of discharging air and introducing liquid.

In one embodiment, the communicating portion is provided continuously all over the periphery of the partition wall.

In one embodiment, when the ink cartridge is used, the air intake is located on the top of the ink cartridge and communicates with the negative pressure generator chamber, and the liquid supply port is located in the bottom of the negative pressure generator chamber.

In one embodiment, the liquid supply port is located about the middle of the negative pressure generator chamber.

In some embodiment, the negative pressure generator includes first and second negative pressure generators, the generator chamber containing the first and second pressure generators pressing against each other. In this case, the capillary force of the first negative pressure generator is higher than that of the second negative pressure generator; the interface between the first and second negative pressure generators is perpendicular to the partition wall; the first negative pressure generator communicates with the communicating portion, is in contact with the liquid supply port, and communicates with the air intake only via the interface; the second negative pressure generator communicates with the communicating portion only via the interface; and the interface is located above a surface discharging air into the liquid chamber.

The lower end of the partition wall may be located below the interface between the first and second negative pressure generators.

The negative pressure generator may be formed of a fibrous material.

The gas-liquid interface is close to horizontal when gas-liquid exchange is performed. In addition, before gas-liquid exchange starts, the gas-liquid interface in the negative pressure generators is reset at the interface between the negative pressure generators. Therefore, variation of the level of the gas-liquid interface when gas-liquid exchange starts is reduced, and the negative pressure when gas-liquid exchange is performed is further stabilized.

Of course, when the ink cartridge according to the present invention is used in an ink-jet recording apparatus, stable and uninterrupted ink supply is performed and stable recording is performed.

Further features and advantages of the present invention will become apparent from the following description of exemplary embodiments (with reference to the attached drawings).

BRIEF DESCRIPTION OF THE DRAWINGS

FIG. 1A is an outside view. FIG. 1B is a sectional view taken along line A-A of FIG. 1A. FIG. 1C is a sectional view taken along line B-B of FIG. 1B. FIG. 1D is a sectional view taken along line C-C of FIG. 1B.

FIG. 2A is a sectional view of the ink cartridge in the state in which ink consumption per unit time is low. FIG. 2B is a sectional view of the ink cartridge in the state in which ink consumption per unit time is high.

FIG. 4A is an outside view. FIG. 4B is a sectional view taken along line A-A of FIG. 4A. FIG. 4C is a sectional view taken along line B-B of FIG. 4B. FIG. 4D is a sectional view taken along line C-C of FIG. 4B.

FIG. 5A is a sectional view of the ink cartridge in the state in which ink consumption per unit time is low. FIG. 5B is a sectional view of the ink cartridge in the state in which ink consumption per unit time is high.

FIG. 6A is an outside view. FIG. 6B is a sectional view taken along line A-A of FIG. 6A. FIG. 6C is a sectional view taken along line B-B of FIG. 6B. FIG. 6D is a sectional view taken along line C-C of FIG. 6B.

FIG. 7A is a sectional view of the ink cartridge in the state in which ink consumption per unit time is low. FIG. 7B is a sectional view of the ink cartridge in the state in which ink consumption per unit time is high.

FIG. 8A is an outside view. FIG. 8B is a sectional view taken along line A-A of FIG. 8A. FIG. 8C is a sectional view taken along line B-B of FIG. 8B. FIG. 8D is a sectional view taken along line C-C of FIG. 8B.

FIG. 9A is a sectional view of the ink cartridge in the state in which ink consumption per unit time is low. FIG. 9B is a sectional view of the ink cartridge in the state in which ink consumption per unit time is high.

FIG. 10A is an outside view. FIG. 10B is a sectional view taken along line A-A of FIG. 10A. FIG. 10C is a sectional view taken along line B-B of FIG. 10B. FIG. 10D is a sectional view taken along line C-C of FIG. 10B.

FIG. 11A is a sectional view of the ink cartridge in the state in which ink consumption per unit time is low. FIG. 11B is a sectional view of the ink cartridge in the state in which ink consumption per unit time is high.

FIG. 12A illustrates the gas-liquid exchange when ink consumption per unit time is low. FIG. 12B illustrates the gas-liquid exchange when ink supply to the ink-jet recording head has increased. FIG. 12C illustrates the gas-liquid exchange when ink supply to the ink-jet recording head has further increased.

DESCRIPTION OF THE EMBODIMENTS

Figure 1A:
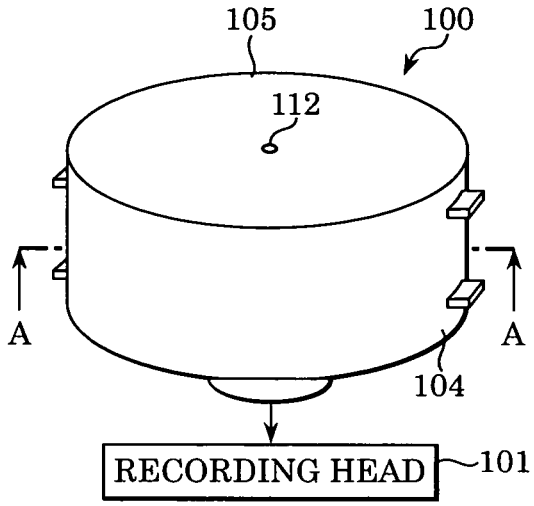
FIGS. 1A to 1D schematically illustrate an ink cartridge according to a first embodiment of the present invention.

Embodiments of the present invention will now be described with reference to the drawings. In the drawings, the same reference numerals are used to designate the same components or portions. The sectional views of the ink cartridge show the state in which consumption of the ink in the negative pressure generator progresses and ink moves from the liquid chamber to the negative pressure generator (gas-liquid exchange is performed). The shaded area shows the ink held in the negative pressure generator.

In order to simplify the drawings, in some drawings, air bubbles come out of only part of the communicating portion. In the following description, ink is taken as an example of liquid. However, the present invention is not limited to ink. The liquid may be a liquid for processing an ink-jet recording medium.

First Embodiment

Figure 1B:
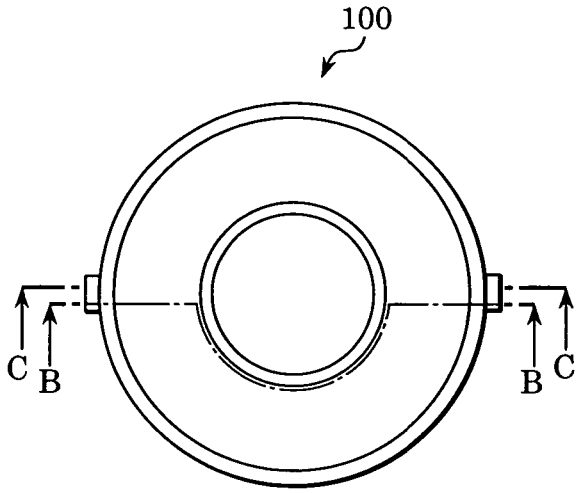
Figure 1C:
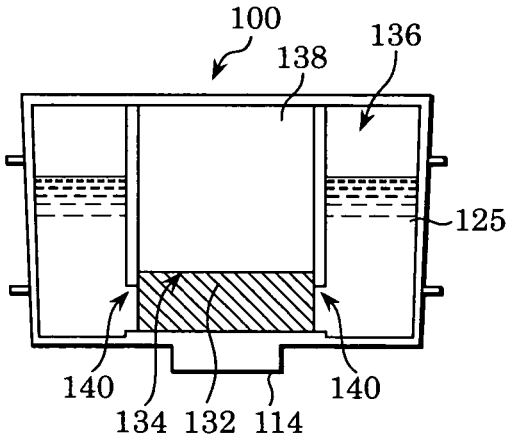
Figure 1D:
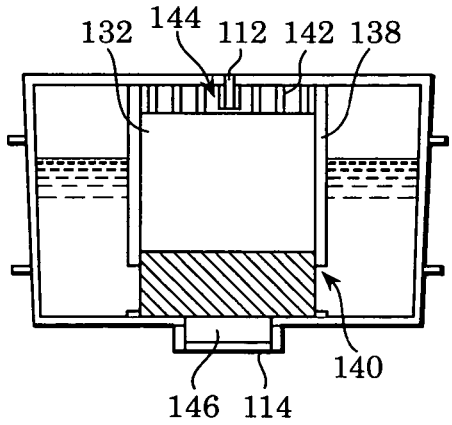
Figure 2A:
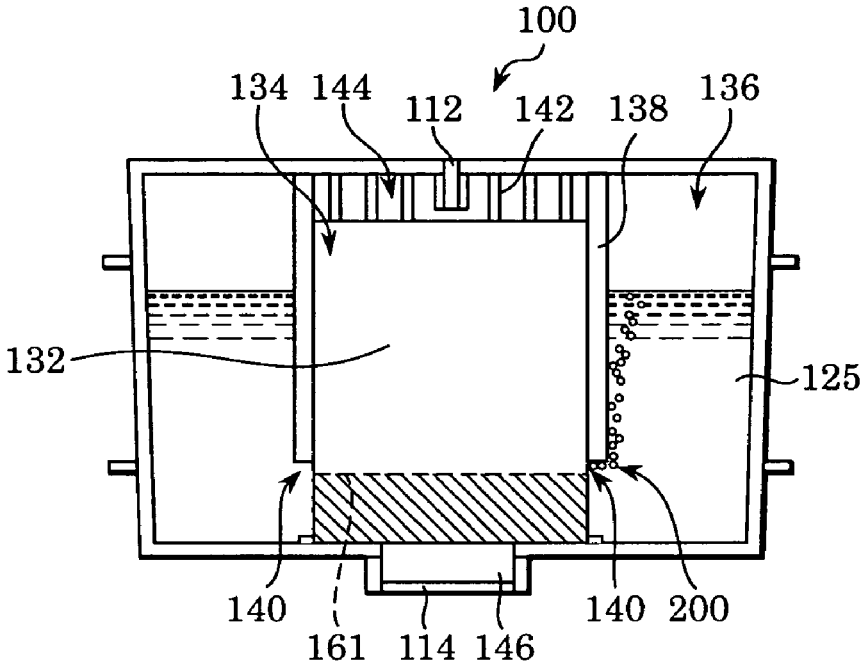
FIGS. 2A and 2B schematically illustrate the first embodiment.
Figure 2B:
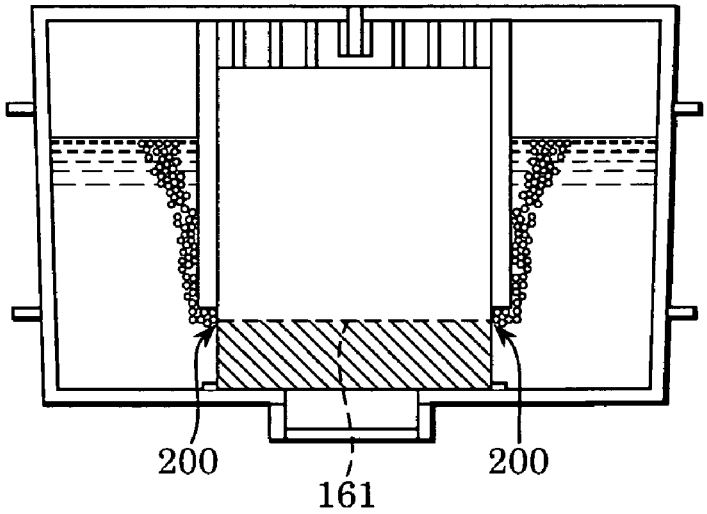

FIGS. 1A to 1D, 2A, and 2B schematically illustrate an ink cartridge according to a first embodiment of the present invention. FIG. 1A is an outside view. FIG. 1B is a sectional view taken along line A-A of FIG. 1A. FIG. 1C is a sectional view taken along line B-B of FIG. 1B. FIG. 1D is a sectional view taken along line C-C of FIG. 1B. FIG. 2A illustrates the state in which ink consumption per unit time is relatively low. FIG. 2B illustrates the state in which ink consumption per unit time is high.

Structure of Ink Cartridge

The structure of the ink cartridge (ink container) 100 shown in FIGS. 1A to 1D, 2A, and 2B will be described. A solid cylindrical negative pressure generator 132 is contained in a negative pressure generator chamber 134. A cylindrical liquid chamber 136 surrounds the negative pressure generator chamber 134. The negative pressure generator chamber 134 and the liquid chamber 136 are separated by a bulkhead (partition wall) 138.

As shown in FIG. 2A, the space inside the ink cartridge 100 is divided by the cylindrical bulkhead 138 into two parts, that is to say, the negative pressure generator chamber 134 located inside the bulkhead 138 and the liquid chamber 136 located outside the bulkhead 138.

The upper part of the negative pressure generator chamber 134 communicates with the atmosphere via an air intake port 112. The lower part communicates with an ink supply port 114 located in the middle of the bottom of the ink cartridge 100. The negative pressure generator chamber 134 contains the negative pressure generator 132.

The liquid chamber 136 is substantially hermetically sealed and contains liquid (ink) 125 directly (without using a negative pressure generator).

The negative pressure generator chamber 134 and the liquid chamber 136 communicate with each other in the vicinity of the bottom of the ink cartridge 100, only via a communicating portion 140 provided in the bulkhead 138.

Part of the upper wall of the ink cartridge 100 that constitutes the negative pressure generator chamber 134 is integrally provided with a plurality of ribs 142 projecting inward, and is in contact with the negative pressure generator 132, which is compressed and contained in the negative pressure generator chamber 134.

These ribs 142 form a space (a buffer chamber) 144 between the upper wall of the ink cartridge 100 and the upper surface of the negative pressure generator 132.

The negative pressure generator chamber 134 is provided with an ink supply cylinder, which has the ink supply port 114. The ink supply cylinder contains a pressed body 146 having higher capillary force and higher physical strength than the negative pressure generator 132. The pressed body 146 is pressed against the negative pressure generator 132.

Next, a method for manufacturing this ink cartridge will be described briefly.

The ink cartridge 100 includes a hollow case 104 having an opening at the upper end, a cylindrical bulkhead 138, a lid 105 provided with ribs 142, a negative pressure generator 132, and a pressed body 146.

First, the pressed body 146 is inserted into a predetermined portion of the case 104 (into the ink supply cylinder). Next, the negative pressure generator 132 is inserted into the case 104. Next, the lid 105 is placed in the opening at the upper end of the case 104, and welded to the case 104. In this way, the negative pressure generator chamber 134 is formed inside the bulkhead 138, and the liquid chamber 136 is formed outside the bulkhead 138. The negative pressure generator chamber 134 and the liquid chamber 136 are substantially hermetically sealed except for the communicating portion 140 of the bulkhead 138. Finally, ink 125 is poured into the ink cartridge 100 through an ink inlet (not shown) so as to complete the ink cartridge 100.

Air Outlet

The negative pressure generator chamber 134 containing the negative pressure generator 132 is surrounded by the liquid chamber 136 containing ink directly. The entire peripheral surface of the negative pressure generator 132 that is directly in contact with the ink 125 in the liquid chamber 136 through the communicating portion 140 in the lower part of the bulkhead 138 can introduce air.

Material of Negative Pressure Generator

Various materials having capillary force, for example, a porous body such as foamed polyurethane, and a fibrous material may be used as the negative pressure generator 132.

There is wide choice in fibrous materials compared to porous bodies such as foamed polyurethane. Therefore, a material having high tolerance to ink can be selected from fibrous materials. If the negative pressure generator 132 is formed of such a material, it is possible to provide an ink cartridge having high tolerance to ink.

Tolerance to ink is the degree to which resin or fiber can be directly or intermittently in contact with liquid ink or ink vapor without being affected by the ink. If the tolerance to ink is low, the resin itself may deteriorate or crystals of the resin may be affected, and therefore the resin may lose its original characteristics. This does not depend on whether the state of ink is fresh or thickened.

If a fibrous material made of a thermoplastic resin or a fibrous material made of the same material as the main body of the ink cartridge is selected, it is possible to provide an ink cartridge having excellent recycling efficiency.

If a fibrous material having a core-clad structure is selected, fibers can be firmly fixed to each other at intersections. Therefore, the ability to hold ink (capillary force) is stabilized, and it is possible to provide an ink cartridge whose ink-holding characteristics, that is to say, negative pressure characteristics are stable.

The core-clad structure is, as described in Japanese Patent Laid-Open No. 2000-301740, a double-layered structure in which a core of a fiber is covered in a surface layer (clad).

In this embodiment, the negative pressure generator 132 is thermoformed of olefin resin fiber having a polypropylene core and a polyethylene clad.

The melting point of polypropylene is different from that of polyethylene. Thermoforming at a temperature between the melting point of the lower melting point material (polyethylene) and the melting point of the higher melting point material (polypropylene) makes it possible to use the lower melting point material (polyethylene) as an adhesive. By melting the polyethylene clad, fibers can be easily fixed to each other at intersections. Therefore, the above-described excellent ink cartridge can be easily obtained.

Gas-Liquid Exchange

The negative pressure generator 132 contained in the negative pressure generator chamber 134 can be viewed as an aggregate of many capillaries, and its meniscus force can generate negative pressure.

In the very early stage of use of the ink cartridge 100, the negative pressure generator 132 is normally impregnated with sufficient amount of ink 125. Therefore, the water heads of capillaries are sufficiently high.

As the ink is supplied to the recording head 101 shown in FIG. 1A through the ink supply port 114 and consumed, the pressure in the bottom of the negative pressure generator chamber 134 lowers, and the water heads of capillaries also lowers.

That is to say, the gas-liquid interface 161 in the negative pressure generator 132 lowers with the ink consumption. FIG. 2A shows the state in which ink consumption has progressed and the gas-liquid interface 161 has further lowered.

In this embodiment, the meniscus is broken in part of the air outlet 200 around the negative pressure generator 132, and the gas-liquid interface 161 is stabilized at the level shown in FIG. 2A. The gas-liquid interface 161 hardly lowers any more, and air is introduced into the liquid chamber 136.

The introduction of air into the liquid chamber 136 makes the pressure in the liquid chamber 136 higher than the pressure in the bottom of the negative pressure generator chamber 134. In order to eliminate this pressure difference, ink 125 is supplied from the liquid chamber 136 to the negative pressure generator chamber 134.

As ink consumption per unit time increases further, in this embodiment, the meniscus is broken in every part one after another as shown in FIG. 2B, although the meniscus force of the air outlet around the negative pressure generator 132 is still substantially constant. Finally, a wide air outlet 200 extending all over the periphery of the negative pressure generator 132 is ensured. That is to say, many passages for introducing air can be ensured. Therefore, it is possible to quickly introduce a large amount of air (the same amount of air as the amount of ink going out) into the liquid chamber 136 without lowering the gas-liquid interface 161 in the negative pressure generator 132.

When the ink consumption by the head through the ink supply port 114 is decreased or interrupted, the gas-liquid interface 161 rises so as to restore the meniscus of the air outlet, thereby stopping the gas-liquid exchange.

As described above, the air outlet extends all over the periphery of the negative pressure generator 132. Therefore, gas-liquid exchange can start in any part of the periphery. Basically, the meniscus force of the air outlet is substantially constant. Therefore, gas-liquid exchange can be performed all over the periphery at the same time.

Once the gas-liquid exchange is started, the gas-liquid exchange can be performed almost without lowering the gas-liquid interface.

Unlike the prismatic negative pressure generator chambers of the conventional ink cartridges, the negative pressure generator chamber of this embodiment has neither ridges (the term "ridge" means a line where two inner surfaces meet) nor corners where three inner surfaces meet.

In the conventional ink cartridges, a gap is formed between a ridge of the negative pressure generator chamber and the negative pressure generator. If the gap extends from the ink supply port to the liquid chamber, air comes into the liquid chamber via the gap from the ink supply port. This causes unwanted gas-liquid exchange, and ink leaks from the ink supply port 114. This embodiment can prevent such a phenomenon.

In the present invention, the negative pressure generator 132 is a cylinder (the term "cylinder" includes an elliptic cylinder), and therefore the negative pressure generator chamber 134 containing the negative pressure generator 132 is also a cylinder. Therefore, the negative pressure generator chamber 134 has only two circular ridges around the top and bottom inner surfaces.

It is only necessary to dispose the bottom of the negative pressure generator 132 such that the ink supply port 114 is out of contact with the communicating portion 140. Then, the entire periphery of the negative pressure generator 132 can be used as an air outlet, and the air outlet can be formed most efficiently.

In this embodiment, interruption of ink supply does not occur, and stable ink supply to the recording head is possible. Therefore, the ink cartridge of this embodiment is reliable and suitable for an ink-jet recording apparatus having a highly improved recording speed.

Reduction in Flow Resistance When Ink is Supplied to Ink-Jet Recording Head

Figure 3:
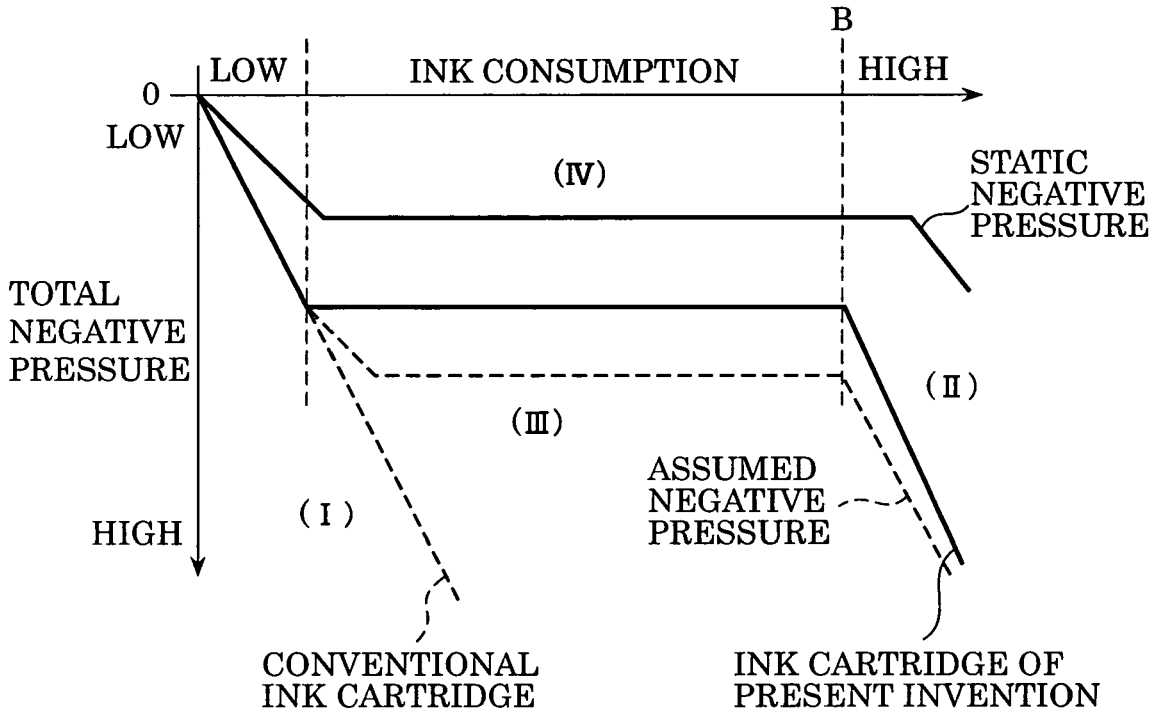
FIG. 3 is a diagram showing the flow resistance when ink is supplied to the recording head.

FIG. 3 is a diagram showing the flow resistance when ink is supplied to the ink-jet recording head 101.

The vertical axis shows the dynamic negative pressure (total negative pressure) including the flow resistance when ink is supplied. The horizontal axis shows the total consumption of ink supplied from the ink cartridge.

The line I shows the total negative pressure of the conventional ink cartridge. The line II shows the total negative pressure of the ink cartridge 100 of the present exemplary embodiment from the beginning to the end of use. The line III shows the total negative pressure of the conventional ink cartridge on the assumption that gas-liquid exchange is sufficiently performed. The line IV shows change in the static negative pressure of the conventional ink cartridge and the ink cartridge of the present exemplary embodiment.

In these cases, the same amount of ink is supplied and flows in a unit of time.

The total negative pressure of the conventional ink cartridge increases with the increase of the ink consumption (line I). The reason is that the amount of gas-liquid exchange is smaller than the amount of ink supplied and flowing in a unit of time, and stable ink supply is not possible.

When the line III is compared to the line II, the ink cartridge 100 of the present exemplary embodiment can supply ink at a lower negative pressure than that of the conventional ink cartridge.

The reason is that the ink cartridge 100 of this embodiment can increase the area of the air outlet as described above and therefore can quickly introduce a large amount of air (the same amount of air as the amount of ink going out) into the liquid chamber 136 without lowering the gas-liquid interface 161 in the negative pressure generator 132 compared to the conventional ink cartridge.

The conventional ink cartridge takes time to obtain the area of the air outlet necessary for gas-liquid exchange compared to the ink cartridge of this embodiment. That is to say, the ink cartridge of this embodiment can start stable gas-liquid exchange in a shorter time than the conventional ink cartridge. Therefore, in the ink cartridge of this embodiment, flow resistance is stabilized in a shorter time (with lower ink consumption) than the conventional ink cartridge, and consequently a stable ink supply is possible at low negative pressure.

Second Embodiment

Figure 4A:
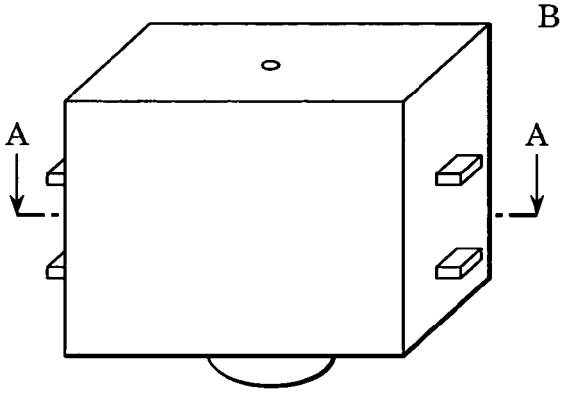
FIGS. 4A to 4D schematically illustrate an ink cartridge according to a second embodiment.
Figure 4B:
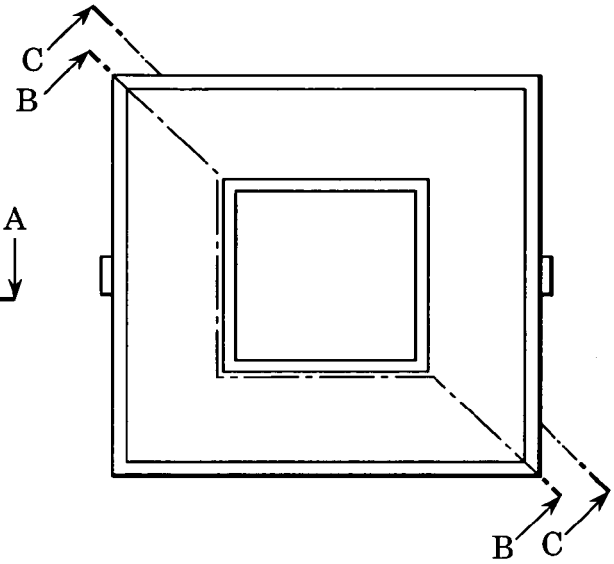
Figure 4C:
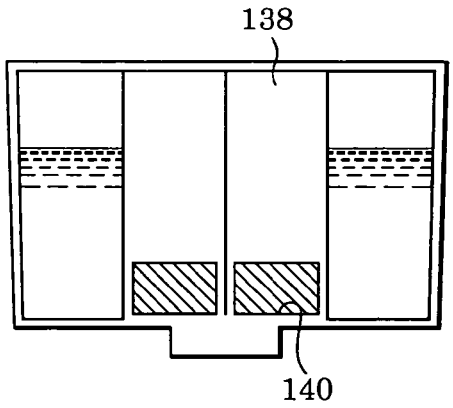
Figure 4D:
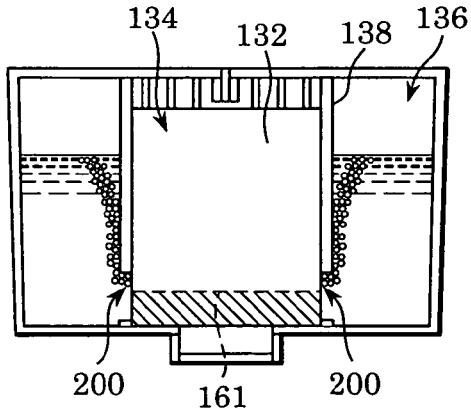
Figure 5A:
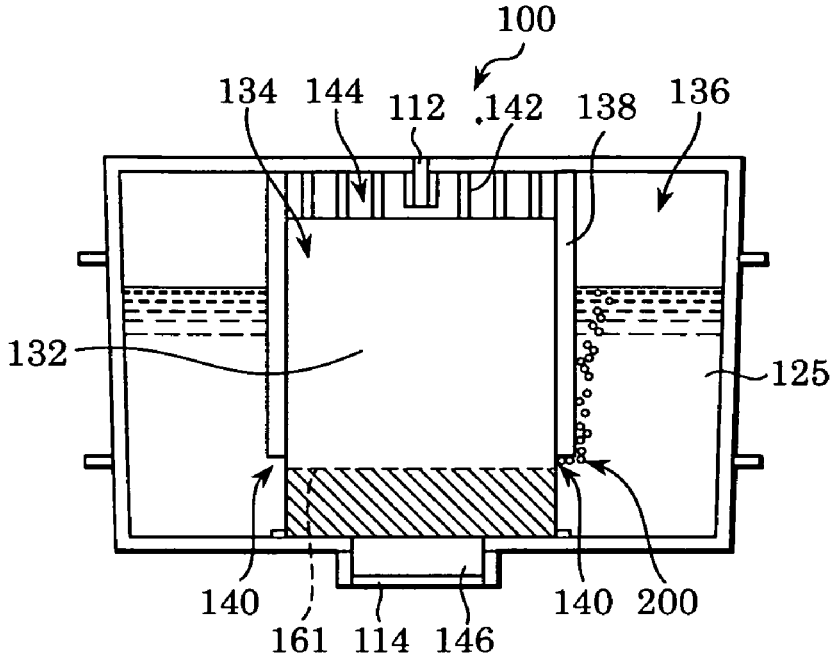
FIGS. 5A and 5B schematically illustrate the second embodiment.
Figure 5B:
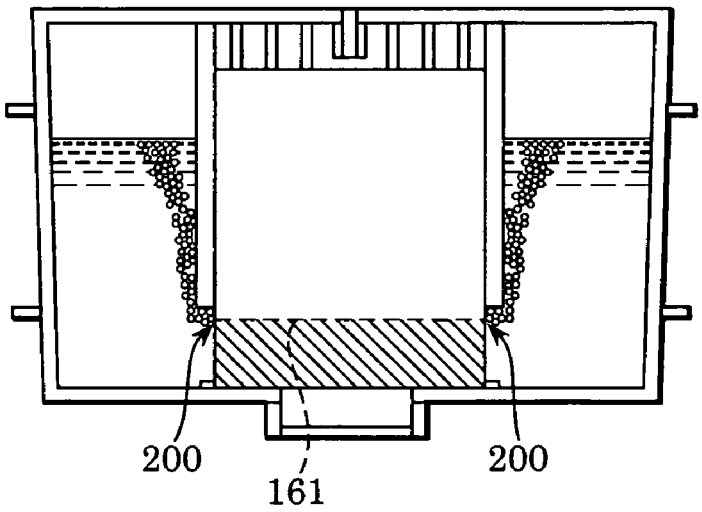

FIGS. 4A to 4D, 5A, and 5B schematically illustrate an ink cartridge according to a second embodiment of the present invention. FIG. 4A is an outside view. FIG. 4B is a sectional view taken along line A-A of FIG. 4A. FIG. 4C is a sectional view taken along line B-B of FIG. 4B. FIG. 4D is a sectional view taken along line C-C of FIG. 4B. FIG. 5A illustrates the state in which ink consumption per unit time is relatively low. FIG. 5B illustrates the state in which ink consumption per unit time is high.

The basic structure and operation of this embodiment are the same as those of the first embodiment, and therefore the description will be omitted. The difference from the first embodiment is the shape of the negative pressure generator 132 in which the air outlet 200 is formed. In the first embodiment, it is cylindrical. In this embodiment, it has a square pillared shape as shown.

In order to prevent the ink leakage described in the first embodiment, a partition wall 138 is disposed such that the inner ridge of the negative pressure generator chamber 134 is out of contact with the communicating portion.

Unlike the first embodiment, the communicating portion 140 is not provided all over the peripheral of the partition wall 138. A plurality of communicating portions 140 are provided partly in the periphery of the partition wall 138.

In this embodiment, since there are corner pillars between the communicating portions 140, the area of the air outlet 200, which is characteristic of the present invention, is slightly small compared to the first embodiment.

However, when the negative pressure generator 132 is inserted into the negative pressure generator chamber 134, the negative pressure generator 132 can be inserted along the corner pillars.

Third Embodiment

Figure 6A:
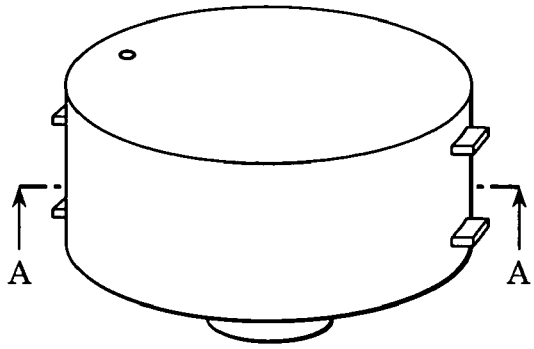
FIGS. 6A to 6D schematically illustrate an ink cartridge according to a third embodiment.
Figure 6B:
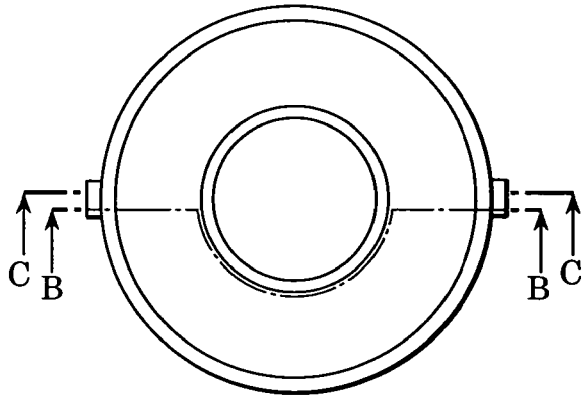
Figure 6C:
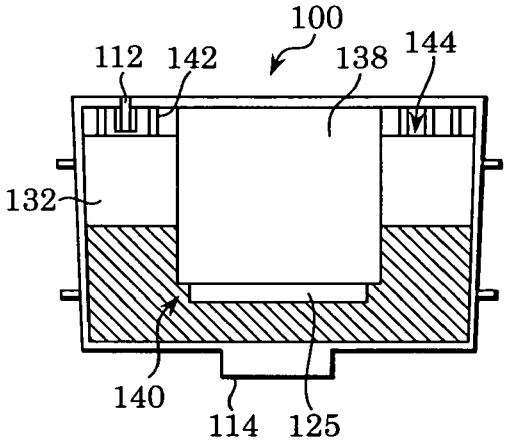
Figure 6D:
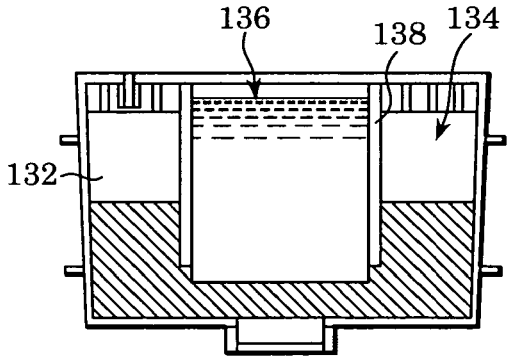
Figure 7A:
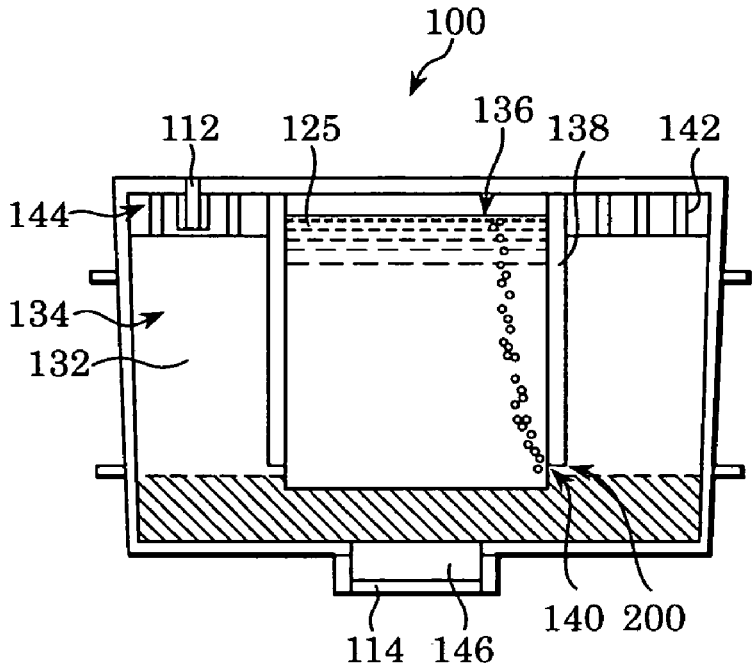
FIGS. 7A and 7B schematically illustrate the third embodiment.
Figure 7B:
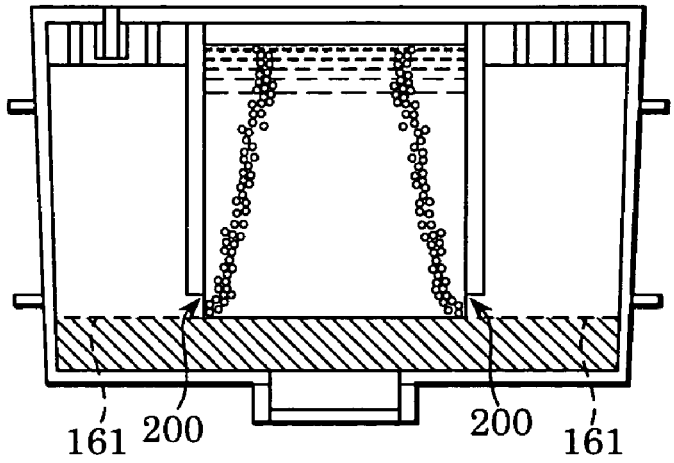

FIGS. 6A to 6D, 7A, and 7B schematically illustrate an ink cartridge according to a third embodiment of the present invention. FIG. 6A is an outside view. FIG. 6B is a sectional view taken along line A-A of FIG. 6A. FIG. 6C is a sectional view taken along line B-B of FIG. 6B. FIG. 6D is a sectional view taken along line C-C of FIG. 6B. FIG. 7A illustrates the state in which ink consumption per unit time is relatively low. FIG. 7B illustrates the state in which ink consumption per unit time is high.

In the above-described first and second embodiments, the liquid chamber 136 surrounds the negative pressure generator chamber 134. In this embodiment, reversely, the negative pressure generator chamber 134 surrounds the liquid chamber 136.

Other structure and basic principle of gas-liquid exchange are the same as those of the above embodiments, and therefore the description will be omitted.

In the first embodiment, a wall is provided on the bottom of the ink cartridge in order to prevent ink leakage occurring when the negative pressure generator 132 is not sufficiently pressed against the inner ridge of the negative pressure generator chamber 134. In this embodiment, it is not necessary to provide such a wall. This embodiment has a simple structure and high reliability.

Figure 8A:
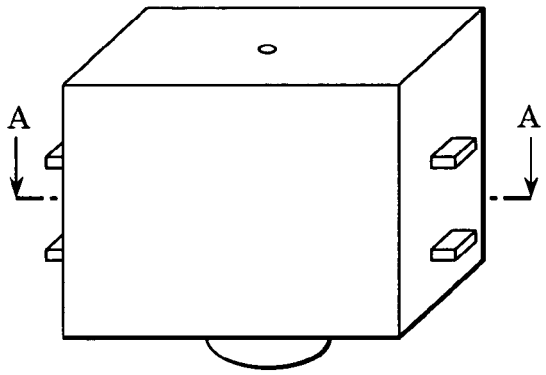
FIGS. 8A to 8D schematically illustrate an ink cartridge according to a modification of the third embodiment.
Figure 8B:
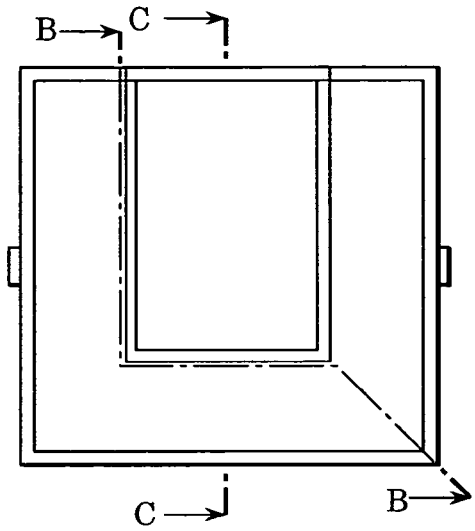
Figure 8C:
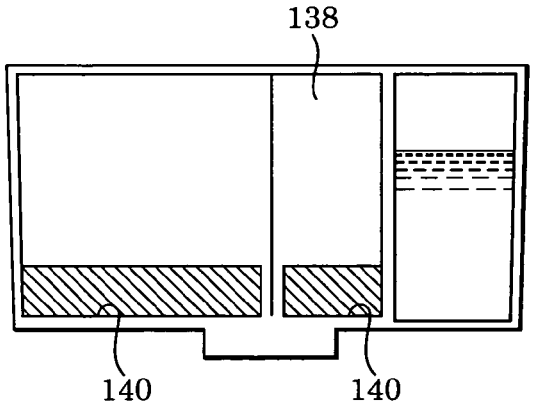
Figure 8D:
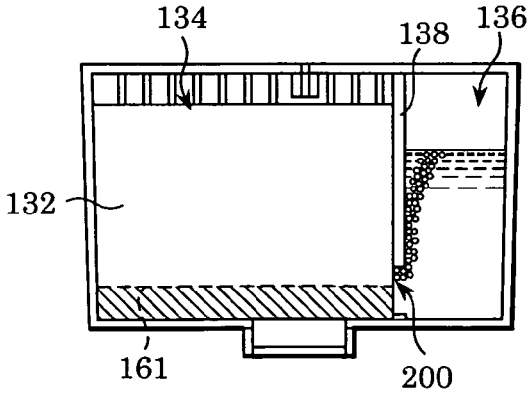
Figure 9A:
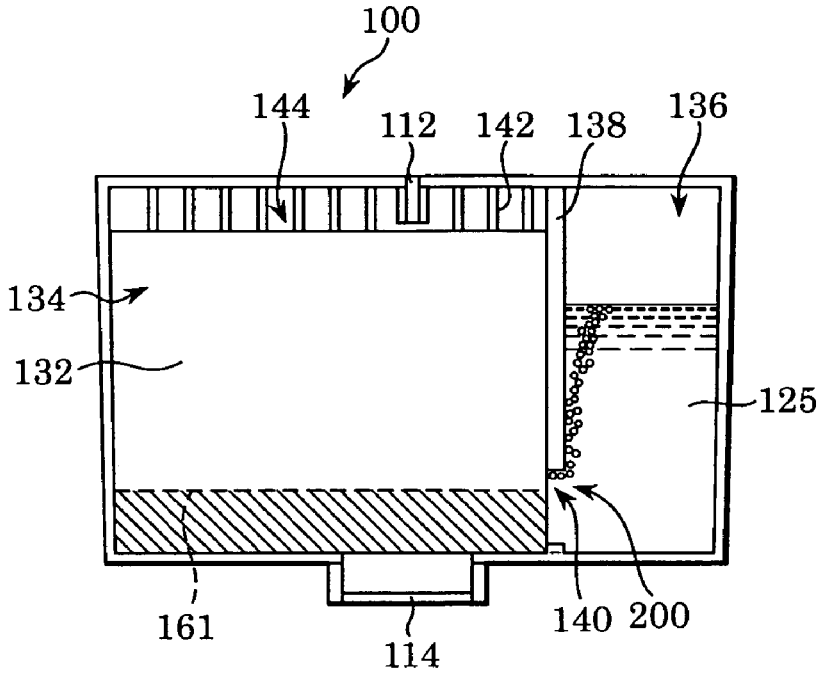
FIGS. 9A and 9B schematically illustrate the modification of the third embodiment.
Figure 9B:
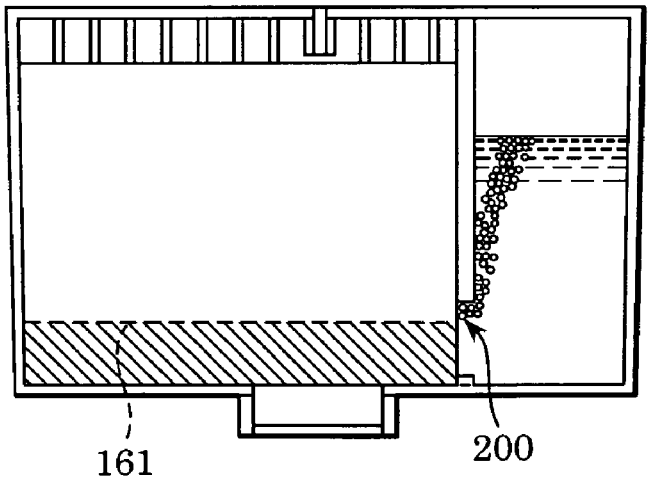

FIGS. 8A to 8D, 9A, and 9B schematically illustrate an ink cartridge according to this embodiment. FIG. 8A is an outside view. FIG. 8B is a sectional view taken along line A-A of FIG. 8A. FIG. 8C is a sectional view taken along line B-B of FIG. 8B. FIG. 8D is a sectional view taken along line C-C of FIG. 8B. FIG. 9A illustrates the state in which ink consumption per unit time is relatively low. FIG. 9B illustrates the state in which ink consumption per unit time is high. The basic structure and operation of this modification are the same as those of the first embodiment, and therefore the description will be omitted.

In this embodiment, the negative pressure generator 132 has a square pillared shape as in the second embodiment. However, this embodiment is different from the second embodiment in the position of the negative pressure generator chamber 134 in the ink cartridge 100.

In the second embodiment, the liquid chamber 136 surrounds the square-pillar-shaped negative pressure generator chamber 134. In this embodiment, the U-shaped liquid chamber 136 partly surrounds the square-pillar-shaped negative pressure generator chamber 134.

In this embodiment, the area of the air outlet 200, which is characteristic of the present invention, is reduced to about /3;4 compared to the second embodiment. However, when the negative pressure generator 132 is inserted into the negative pressure generator chamber 134, the negative pressure generator 132 can be inserted along the wall that does not constitute the partition wall 138. Therefore, the negative pressure generator 132 of this embodiment can be inserted more stably than that of the second embodiment. Therefore, the ink cartridge of this embodiment has excellent productivity.

Fourth Embodiment

Figure 10A:
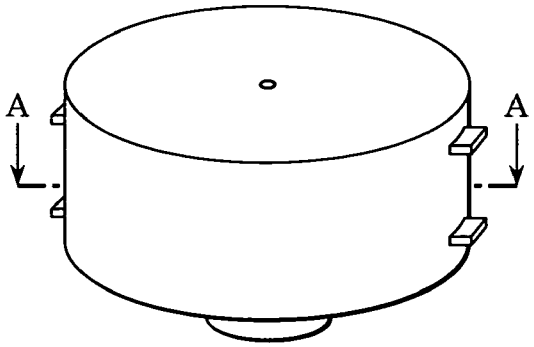
FIGS. 10A to 10D schematically illustrate an ink cartridge according to a fourth embodiment.
Figure 10B:
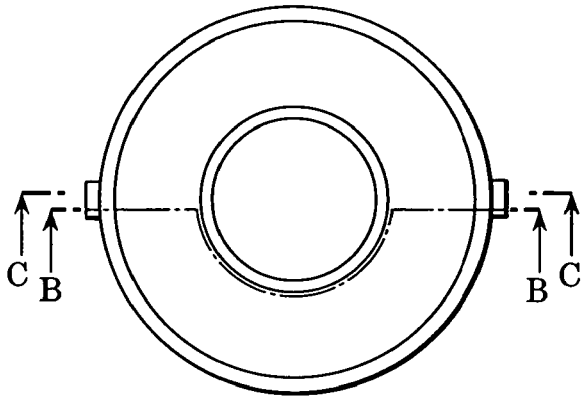
Figure 10C:
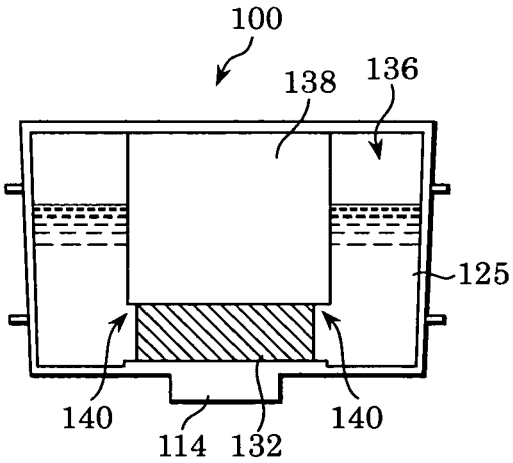
Figure 10D:
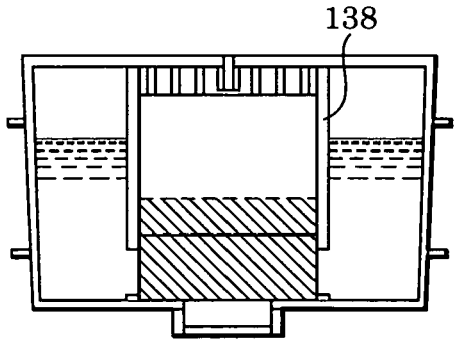
Figure 11A:
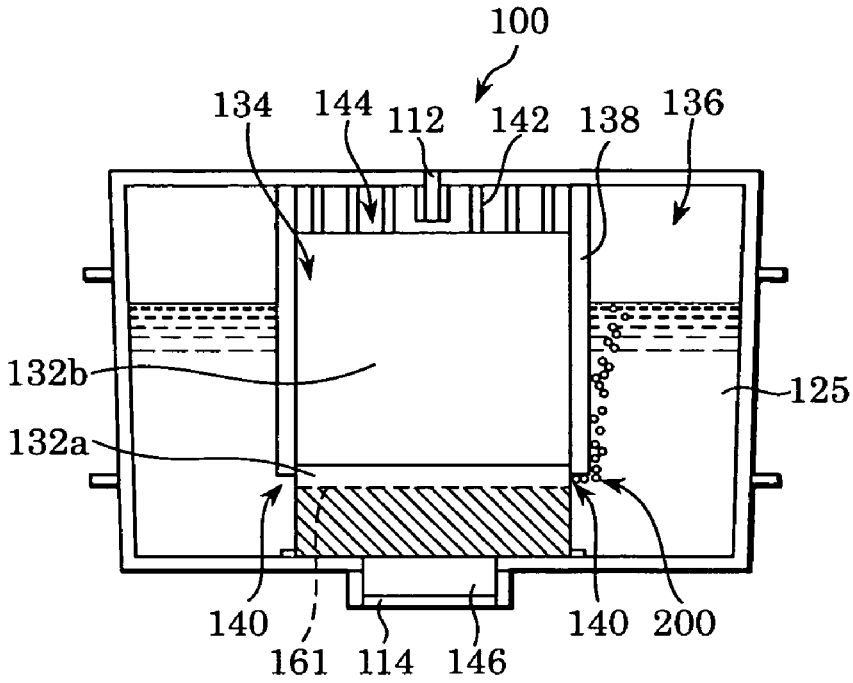
FIGS. 11A and 11B schematically illustrate the fourth embodiment.
Figure 11B:
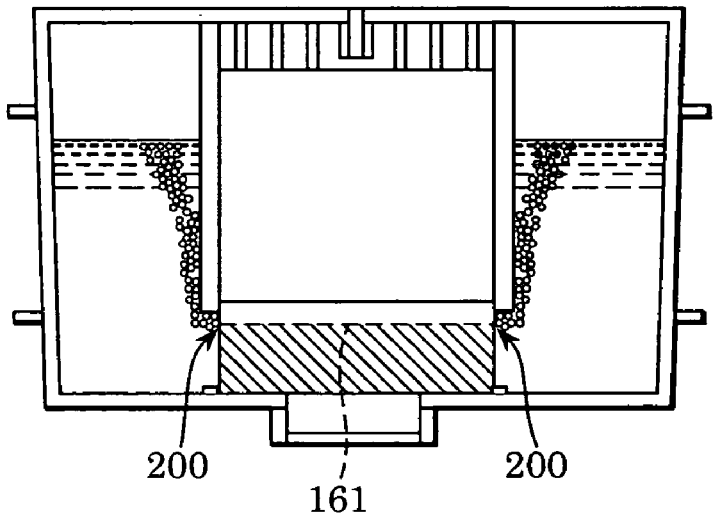
Figure 12A:
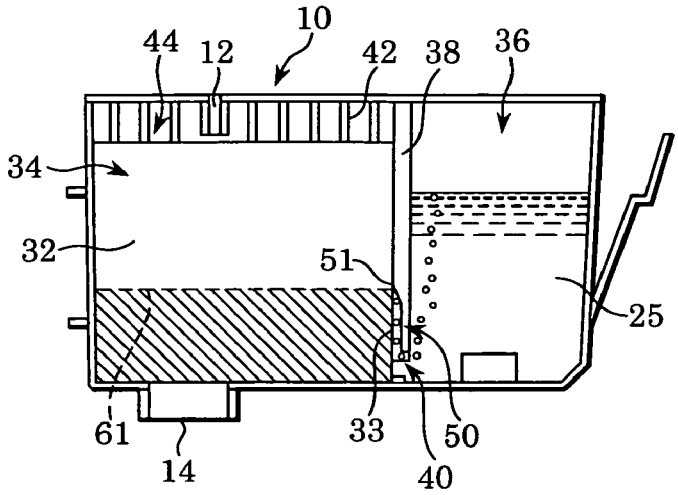
FIG. 12A PRIOR ART
FIGS. 12A to 12C are schematic sectional views of an ink cartridge having a conventional structure.
Figure 12B:
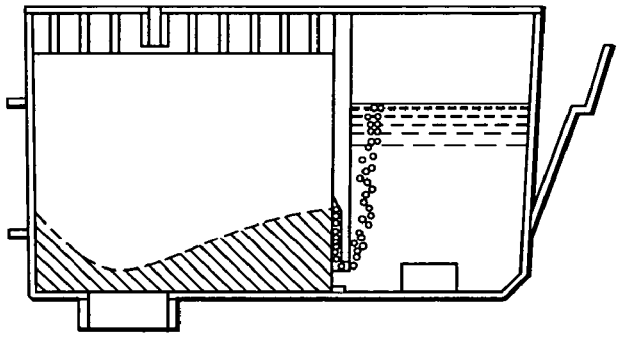
FIG. 12B PRIOR ART
Figure 12C:
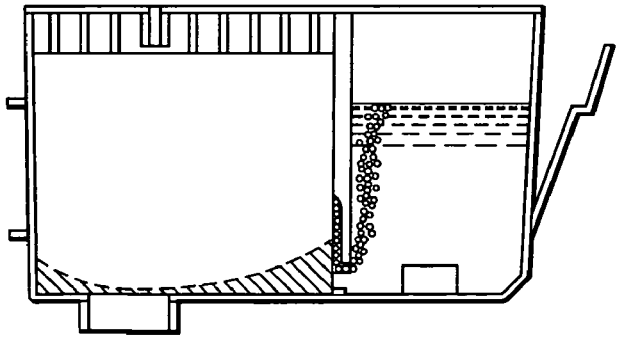
FIG. 12C PRIOR ART

FIGS. 10A to 10D, 11A, and 11B schematically illustrate an ink cartridge according to a fourth embodiment of the present invention. FIG. 10A is an outside view. FIG. 10B is a sectional view taken along line A-A of FIG. 10A. FIG. 10C is a sectional view taken along line B-B of FIG. 10B. FIG. 10D is a sectional view taken along line C-C of FIG. 10B. FIG. 11A illustrates the state in which ink consumption per unit time is relatively low. FIG. 11B illustrates the state in which ink consumption per unit time is high. The basic structure and operation of this embodiment are the same as those of the first embodiment, and therefore the description will be omitted.

The difference between this embodiment and the first embodiment is that the negative pressure generator is divided into two. The negative pressure generator chamber 134 contains first and second negative pressure generators 132*a* and 132*b* pressing against each other. The capillary force of the first negative pressure generator 132*a* is higher than that of the second negative pressure generator 132*b*. The interface between the first and second negative pressure generators 132*a* and 132*b* is perpendicular to the partition wall 138.

The first negative pressure generator 132*a* communicates with the communicating portion 140, and is capable of communicating with the air intake port 112 only via the interface between the first and second negative pressure generators 132*a* and 132*b*. The second negative pressure generator 132*b* is capable of communicating with the communicating portion 140 only via the interface between the first and second negative pressure generators 132*a* and 132*b*.

The air outlet 200 and the lower end of the partition wall 138 (the upper end of the communicating portion 140) are located below the interface between the two negative pressure generators 132*a* and 132*b*.

In this embodiment, when the gas-liquid interface 161 in the negative pressure generators lowers with the consumption of ink, since the capillary force of the first negative pressure generator 132*a* is higher than that of the second negative pressure generator 132*b*, the ink in the first negative pressure generator 132*a* is always consumed after the ink in the second negative pressure generator 132*b* has been consumed. Therefore, the gas-liquid interface 161 becomes substantially horizontal at the interface between the first and second negative pressure generators 132*a* and 132*b*, and then lowers up to the air outlet.

Therefore, compared to the above embodiments, as shown in the dashed line, the gas-liquid interface 161 is close to horizontal when gas-liquid exchange is performed.

In addition, before gas-liquid exchange starts, the gas-liquid interface 161 is reset at the interface between the negative pressure generators 132*a* and 132*b*. Therefore, variation of the level of the gas-liquid interface 161 when gas-liquid exchange starts is reduced, and the negative pressure when gas-liquid exchange is performed is further stabilized.

In the above embodiments, the negative pressure generator chamber 134 and the ink cartridge 100 have similar shapes. However, the negative pressure generator chamber 134 and the ink cartridge 100 do not need to have similar shapes. For example, a square-pillar-shaped ink cartridge 100 including a cylindrical negative pressure generator chamber 134 is also reliable and ensures stable ink supply.

In the above embodiments, the negative pressure generator chamber 134 surrounded by the liquid chamber 136 and the liquid chamber 136 surrounded by the negative pressure generator chamber 134 have a cylindrical or square pillared shape. However, of course, they may have another pillar shape such as a triangular pillared shape.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-175546 filed Jun. 14, 2004, which is hereby incorporated by reference herein.

What is claimed is:

1. An ink cartridge comprising:

a negative pressure generator configured to absorb and hold liquid;

a negative pressure generator chamber containing the negative pressure generator, the negative pressure generator chamber including a liquid supply port configured to supply liquid to a recording head, and an air intake port communicating with the atmosphere;

a pressed body arranged at the ink supply port and contacting the negative pressure generator;

a liquid chamber adapted to contain liquid and surrounding the negative pressure generator chamber; and a partition wall having a communicating portion connecting the negative pressure generator chamber and the liquid chamber, the partition wall separating the negative pressure generator chamber and the liquid chamber except at the communicating portion, wherein the liquid chamber is substantially hermetically-sealed except at the communicating portion, and wherein the communicating portion is provided continuously all over the periphery of the partition wall.

2. The ink cartridge according to claim 1, wherein the liquid chamber, the communicating portion, and the negative pressure generator chamber contain liquid.

3. The ink cartridge according to claim 1, wherein as liquid is consumed in the negative pressure generator, air is introduced into the negative pressure generator chamber only via the air intake port and then comes into the liquid chamber through the communicating portion, and wherein as liquid in the liquid chamber is introduced into the negative pressure generator chamber through the communicating portion to fill the negative pressure generator, the substantially entire peripheral surface of the negative pressure generator communicating with the liquid chamber is capable of discharging air in the negative pressure generator chamber.

4. The ink cartridge according to claim 1, wherein the negative pressure generator has one of a cylindrical and a square pillared shape.

5. The ink cartridge according to claim 1, wherein when the ink cartridge is used, the air intake is located on the top of the ink cartridge and communicates with the negative pressure generator chamber, and the liquid supply port is located at the bottom of the negative pressure generator chamber.

6. The ink cartridge according to claim 1, wherein the liquid supply port is located about the middle of the negative pressure generator chamber.

7. The ink cartridge according to claim 1, wherein the negative pressure generator is formed of a fibrous material.

8. The ink cartridge according to claim 1, wherein the negative pressure generator includes first and second negative pressure generators, the negative pressure generator chamber containing the first and second negative pressure generators pressing against each other, wherein the first negative pressure generator provides a capillary force higher than that of the second negative pressure generator, wherein an interface between the first and second negative pressure generators is perpendicular to the partition wall, wherein the first negative pressure generator communicates with the communicating portion, is in contact with the liquid supply port, and communicates with the air intake port only via the interface, wherein the second negative pressure generator communicates with the communicating portion only via the interface, and wherein the interface is located above a surface discharging air into the liquid chamber.

9. The ink cartridge according to claim 8, wherein a lower end of the partition wall is located below the interface between the first and second negative pressure generators.

10. An ink cartridge comprising:

a negative pressure generator configured to absorb and hold liquid;

a negative pressure generator chamber containing the negative pressure generator, the negative pressure generator chamber including a liquid supply port configured to supply liquid to a recording head, and an air intake port communicating with the atmosphere;

a liquid chamber adapted to contain liquid and suffounded by the negative pressure generator chamber; and a partition wall having a communicating portion connecting the negative pressure generator chamber and the liquid chamber, the partition wall separating the negative pressure generator chamber and the liquid chamber except at the communicating portion, wherein the liquid chamber is substantially hermetically-sealed except at the communicating portion, and wherein the communicating portion is provided at one of continuously in the partition wall and in a plurality of places in the partition wall.

11. An ink cartridge comprising:

a negative pressure generator configured to absorb and hold liquid;

a negative pressure generator chamber containing the negative pressure generator, the negative pressure generator chamber including a liquid supply port configured to supply liquid to a recording head, and an air intake port communicating with the atmosphere;

a liquid chamber adapted to contain liquid; and a partition wall having a communicating portion connecting the negative pressure generator chamber and the liquid chamber, the partition wall separating the negative pressure generator chamber and the liquid chamber except at the communicating portion, wherein the liquid chamber is substantially hermetically-sealed except at the communicating portion, wherein the negative pressure generator chamber is surrounded by the liquid chamber except at a part of the circumference of the negative pressure generator chamber, and wherein the communicating portion follows one of the partition wall except at the part of circumference of the negative pressure generator chamber and in a plurality of places in the partition wall.

12. The ink cartridge according to claim 11, wherein the negative pressure generator has one of a cylindrical and a square pillared shape.

13. The ink cartridge according to claim 11, wherein the negative pressure generator includes first and second negative pressure generators, the negative pressure generator chamber containing the first and second negative pressure generators pressing against each other, wherein the first negative pressure generator provides a capillary force higher than that of the second negative pressure generator, wherein an interface between the first and second negative pressure generators is perpendicular to the partition wall, wherein the first negative pressure generator communicates with the communicating portion, is in contact with the liquid supply port, and communicates with the air intake port only via the interface, wherein the second negative pressure generator communicates with the communicating portion only via the interface, and wherein the interface is located above a surface discharging air into the liquid chamber.

14. An ink cartridge comprising:

a negative pressure generator configured to absorb and hold liquid;

a negative pressure generator chamber containing the negative pressure generator, the negative pressure generator chamber including a liquid supply port configured to supply liquid to a recording head, and an air intake port communicating with the atmosphere;

a liquid chamber adapted to contain liquid; and a partition wall having a communicating portion connecting the negative pressure generator chamber and the liquid chamber, the partition wall separating the negative pressure generator chamber and the liquid chamber except at the communicating portion, wherein the liquid chamber is substantially hermetically-sealed except at the communicating portion, wherein the liquid chamber is suffounded by the negative pressure generator chamber except at a part of the circumference of the negative pressure generator chamber, and wherein the communicating portion is provided at one of continuously in the partition wall and in a plurality of places in the partition wall.

* * * * *